US010443016B2

(12) United States Patent
Komatsubara

(10) Patent No.: US 10,443,016 B2
(45) Date of Patent: Oct. 15, 2019

(54) LUBRICATING OIL COMPOSITION FOR GEAR OIL

(71) Applicant: JXTG NIPPON OIL & ENERGY CORPORATION, Tokyo (JP)

(72) Inventor: Hitoshi Komatsubara, Tokyo (JP)

(73) Assignee: JXTG NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 15/553,375

(22) PCT Filed: Feb. 25, 2016

(86) PCT No.: PCT/JP2016/055615

§ 371 (c)(1),
(2) Date: Aug. 24, 2017

(87) PCT Pub. No.: WO2016/136872

PCT Pub. Date: Sep. 1, 2016

(65) Prior Publication Data

US 2018/0112150 A1 Apr. 26, 2018

(30) Foreign Application Priority Data

Feb. 27, 2015 (JP) ..... 2015-038758

(51) Int. Cl.

| | |
|---|---|
| ***C10M 169/04*** | (2006.01) |
| ***C10M 165/00*** | (2006.01) |
| ***C10M 133/16*** | (2006.01) |
| ***C10M 135/36*** | (2006.01) |
| ***C10M 135/22*** | (2006.01) |
| ***C10M 137/04*** | (2006.01) |

(52) U.S. Cl.

CPC ..... *C10M 169/047* (2013.01); *C10M 165/00* (2013.01); *C10M 169/04* (2013.01); *C10M 2203/1006* (2013.01); *C10M 2203/1025* (2013.01); *C10M 2205/028* (2013.01); *C10M 2205/0285* (2013.01); *C10M 2209/084* (2013.01); *C10M 2215/04* (2013.01); *C10M 2215/064* (2013.01); *C10M 2215/28* (2013.01); *C10M 2219/08* (2013.01); *C10M 2219/106* (2013.01); *C10M 2223/04* (2013.01); *C10M 2223/049* (2013.01); *C10N 2220/021* (2013.01); *C10N 2220/022* (2013.01); *C10N 2230/02* (2013.01); *C10N 2230/06* (2013.01); *C10N 2230/10* (2013.01); *C10N 2230/42* (2013.01); *C10N 2230/76* (2013.01); *C10N 2240/04* (2013.01); *C10N 2240/042* (2013.01); *C10N 2240/044* (2013.01); *C10N 2240/045* (2013.01)

(58) Field of Classification Search

CPC ..... C10M 169/04; C10M 165/00; C10M 169/047; C10M 2203/1006; C10M 2203/1025; C10M 2205/028; C10M 2205/0285; C10M 2209/084; C10M 2215/04; C10M 2215/064; C10M 2215/28; C10M 2219/08; C10M 2219/106; C10M 2223/04; C10M 2223/049; C10N 2220/021; C10N 2220/022; C10N 2230/06; C10N 2230/10; C10N 2230/42; C10N 2230/76; C10N 2240/04; C10N 2240/042; C10N 2240/044; C10N 2240/045

See application file for complete search history.

(56) References Cited

U.S. PATENT DOCUMENTS

| | | | | |
|---|---|---|---|---|
| 5,358,650 | A * | 10/1994 | Srinivasan | C10M 169/048 508/194 |
| 2002/0010103 | A1* | 1/2002 | Takayama | C10M 141/10 508/433 |
| 2012/0040874 | A1* | 2/2012 | Toda | C10M 169/044 508/364 |
| 2013/0345103 | A1* | 12/2013 | Nakao | C10M 169/04 508/372 |
| 2014/0187457 | A1* | 7/2014 | Kanga | C10M 169/04 508/464 |

FOREIGN PATENT DOCUMENTS

| | | | |
|---|---|---|---|
| JP | 2001-303086 | A | 10/2001 |
| JP | 2006-152166 | A | 6/2006 |
| JP | 2007-39480 | A | 2/2007 |
| JP | 2008-208212 | A | 9/2008 |
| JP | 2009-249496 | A | 10/2009 |
| JP | 2010-508422 | A | 3/2010 |
| JP | 2011-121990 | A | 6/2011 |
| JP | 2011-190377 | A | 9/2011 |
| JP | 2011-529513 | A | 12/2011 |
| JP | 2013-249461 | A | 12/2013 |

(Continued)

OTHER PUBLICATIONS

International Search Report from Patent Application No. PCT/JP2016/055615, dated May 10, 2016.

(Continued)

*Primary Examiner* — James C Goloboy

(74) *Attorney, Agent, or Firm* — Greenblum & Bernstein, P.L.C.

(57) ABSTRACT

Disclosed is a lubricating oil composition for gear oil, comprising a lubricating base oil having a kinematic viscosity at 40° C. of 140 to 350 $mm^2/s$, a copolymer of an α-olefin and an ester monomer having a polymerizable unsaturated bond, a performance additive containing phosphorus and sulfur, and a poly(meth)acrylate pour-point depressant.

2 Claims, No Drawings

(56) References Cited

FOREIGN PATENT DOCUMENTS

| | | | |
|---|---|---|---|
| WO | 95/009904 | A1 | 4/1995 |
| WO | 2008/057798 | A2 | 5/2008 |
| WO | 2010/012598 | A2 | 2/2010 |
| WO | 2013/147162 | A | 10/2013 |

OTHER PUBLICATIONS

International Preliminary Report on Patentability from Application No. PCT/JP2016/055615 dated Sep. 8, 2017.
Written Opinion of the International Searching Authoriy from Application No. PCT/JP2016/055615 dated Oct. 5, 2016.
Japanese Office Action issued with respect to Application No. 2015-038758, dated Aug. 7, 2018.
Notice of Allowance issued in counterpart Japanese Patent Application No. JP2015-038758, dated Oct. 30, 2018.

* cited by examiner

LUBRICATING OIL COMPOSITION FOR GEAR OIL

TECHNICAL FIELD

The present invention relates to a lubricating oil composition for gear oil.

BACKGROUND ART

In response to environmental problems, such as reduction of carbon dioxide emissions, energy saving of vehicles, construction machines, agricultural machines, and the like, namely fuel efficiency, has been an urgent issue in recent years. Devices such as engines, transmissions, final reduction gears, compressors, hydraulic systems, and the like are strongly requested to contribute to energy saving. Accordingly, for lubricating oils used for these devices, there is a demand for further reduction in agitation loss and rotation loss rather than conventional lubricating oils.

One of the means for saving the fuel of transmissions and final reduction gears is to reduce the viscosity of lubricating oils. For example, among transmissions, vehicle automatic transmissions and continuously variable transmissions have a torque converter, a wet clutch, a gear bearing mechanism, an oil pump, a hydraulic control mechanism, and the like, and manual transmissions and final reduction gears have a gear bearing mechanism. By reducing the viscosity of the lubricating oils used in these transmissions, the agitation loss and rotational resistance of the torque converter, wet clutch, gear bearing mechanism, oil pump, and the like, are reduced, and the power transmission efficiency is enhanced, thereby improving the fuel consumption of vehicles.

Conventionally proposed lubricating oil compositions are those that are obtained by mixing mineral oil-based and/or synthetic oil-based lubricating base oils mixed with various additives, and that have both high fuel efficiency and sufficient durability of metal parts, such as gears and bearings (see, for example, Patent Literatures 1 and 2)

CITATION LIST

Patent Literature

Patent Literature 1: JP 2008-208212 A
Patent Literature 2: JP 2009-249496 A

SUMMARY OF INVENTION

Technical Problem

However, the reduction in the viscosity of lubricating oils for fuel efficiency may lead to a decrease in the oil film thickness, which may reduce extreme-pressure properties and antiwear property, as well as cause seizure, and the like, thereby resulting in defects in transmissions, and the like.

The present invention has been made in consideration of such circumstances. An object of the present invention is to provide a lubricating oil composition for gears that excels in cold flow property and that has sufficient antiwear property and oxidation stability for achieving fuel efficiency, without the need for reducing the viscosity of the lubricating oil, and that further has a long fatigue life.

Solution to Problem

In order to solve the above problems, the present invention provides the lubricating oil compositions shown in the following [1] to [5], the use (application) of the composition shown in the following [6], and the use (application) of the composition for production shown in the following [7].

[1] A lubricating oil composition for gear oil, comprising:

a lubricating base oil having a kinematic viscosity at 40° C. of 140 to 350 $mm^2/s$;

a copolymer of an α-olefin and an ester monomer having a polymerizable unsaturated bond;

a performance additive containing phosphorus and sulfur; and a poly(meth)acrylate pour-point depressant.

[2] The lubricating oil composition for gear oil according to [1], wherein the lubricating base oil contains a first lubricating base oil component having a kinematic viscosity at 40° C. of 200 to 600 $mm^2/s$ and a sulfur content of 0.3 to 0.9 mass %, and a second lubricating base oil component having a kinematic viscosity at 40° C. of less than 200 $mm^2/s$; and the content of the first lubricating base oil component is 30 to 80 mass %, and the content of the second lubricating base oil component is 70 to 20 mass %, based on the total amount of the base oil.

[3] The lubricating oil composition for gear oil according to [1] or [2], wherein the content of the copolymer is 0.5 mass % or more based on the total amount of the composition.

[4] The lubricating oil composition for gear oil according to any one of [1] to [3], wherein the content of the performance additive satisfies requirements represented by the following Formulas (1) and (2):

$$C_P \geq 0.05 \quad (1)$$

$$7 \leq (C_S/C_P) \leq 20 \quad (2)$$

[wherein $C_P$ represents the content of phosphorus contained in the performance additive, $C_S$ represents the content of sulfur contained in the performance additive, and $C_P$ and $C_S$ each represent a value (mass %) in terms of phosphorus or sulfur element based on the total amount of the composition.]

[5] The lubricating oil composition for gear oil according to any one of [1] to [4], wherein the kinematic viscosity at 140° C. is 6.0 $mm^2/s$ or more.

[6] Use of a composition as a gear lubricating oil, the composition comprising:

a lubricating base oil having a kinematic viscosity at 40° C. of 140 to 350 $mm^2/s$;

a copolymer of an α-olefin and an ester monomer having a polymerizable unsaturated bond;

a performance additive containing phosphorus and sulfur; and a poly(meth)acrylate pour-point depressant.

[7] Use of a composition for producing a gear lubricating oil, the composition comprising:

a lubricating base oil having a kinematic viscosity at 40° C. of 140 to 350 $mm^2/s$;

a copolymer of an α-olefin and an ester monomer having a polymerizable unsaturated bond;

a performance additive containing phosphorus and sulfur, and a poly(meth)acrylate pour-point depressant.

The kinematic viscosity as mentioned in the present invention refers to the kinematic viscosity specified in ASTM D-445. Further, the viscosity index as mentioned in the present invention refers to a viscosity index measured according to JIS K 2283-1993.

Because the oil film thickness under high-load conditions can be significantly improved by using the above lubricating oil composition for gear oil, friction between metal parts can be reduced, and agitation loss at low-temperature starting can be reduced.

Advantageous Effects of Invention

The present invention provides a lubricating oil composition for gears that has excellent cold flow property and sufficient antiwear property and oxidation stability for achieving fuel efficiency, without the need for reducing the viscosity of the lubricating oil, and that further has a long fatigue life. Therefore, when the lubricating oil composition for gears of the present invention is applied to vehicle manual transmissions, automatic transmissions, continuously variable transmissions, final reduction gears, or industrial gear systems, better fuel efficiency can be achieved, while maintaining characteristics required as gear oil. The lubricating oil composition for gears of the present invention is particularly useful for, among gears, hypoid gears that are used as final reduction gears.

DESCRIPTION OF EMBODIMENTS

A preferred embodiment of the present invention is described below.

The lubricating oil composition for gear oil according to the embodiment of the present invention comprises:

a lubricating base oil having a kinematic viscosity at 40° C. of 140 to 350 $mm^2/s$;

a copolymer of an α-olefin and an ester monomer having a polymerizable unsaturated bond;

a performance additive containing phosphorus and sulfur; and a poly(meth)acrylate pour-point depressant.

[Component (A): A Lubricating Base Oil]

The lubricating oil composition for gear oil of the present embodiment (hereinafter, also simply referred to as the "lubricating oil composition") comprises (A) a lubricating base oil. The kinematic viscosity at 40° C. of the lubricating base oil is 140 to 350 $mm^2/s$. The lubricating base oil is not particularly limited, as long as the kinematic viscosity at 40° C. satisfies the above requirements. Base oils used for general lubricating oils can be used. Specific examples include mineral oil base oils, synthetic base oils, and mixtures thereof.

Examples of mineral oil base oils include paraffin-based, naphthene-based and the like mineral oil base oils obtained by subjecting a crude oil to atmospheric distillation and vacuum distillation to obtain lubricating oil fractions, and then refining the lubricating oil fractions by refining processes, such as solvent deasphalting, solvent extraction, hydrocracking, solvent dewaxing, catalytic dewaxing, hydrorefining, sulfuric acid washing, clay treatment, and the like, which are used singly or in appropriate combination of two or more; normal paraffin, isoparaffin, and the like. These mineral oil base oils may be used singly or in combination of two or more at any ratio.

Preferable examples of mineral oil base oils include the following base oils:

(1) distilled oil obtained by atmospheric distillation of a paraffinic crude oil and/or a mixed-base crude oil;
(2) distilled oil obtained by vacuum distillation of an atmospheric distillation residual oil of a paraffinic crude oil and/or a mixed-base crude oil (WVGO);
(3) wax obtained by a lubricating oil dewaxing step and/or Fischer-Tropsch wax produced by a GTL process, and the like;
(4) mild hydrocracking treatment oil (MHC) of a mixed oil of two or more oils selected from (1) to (3);
(5) mixed oil of two or more oils selected from (1) to (4);
(6) deasphalted oil (DAO) of (1), (2), (3), (4), or (5);
(7) mild hydrocracked oil (MHC) of (6); and
(8) lubricating oil obtained by using a mixed oil of two or more oils selected from (1) to (7) as a stock oil, subjecting the stock oil and/or a lubricating oil fraction recovered from the stock oil to a normal refining process, and recovering the lubricating oil fraction.

The normal refining process as mentioned herein is not particularly limited, and any refining process used in the production of base oils can be used. Examples of the normal refining process include:

(a) hydrorefining, such as hydrocracking and hydrofinishing;
(b) solvent refining, such as furfural solvent extraction;
(c) dewaxing, such as solvent dewaxing and catalytic dewaxing;
(d) clay refining with acidic clay, activated clay, and the like; and
(e) chemical (acid or alkali) refining, such as sulfuric acid washing, caustic soda washing, and the like.

In the present embodiment, one or more of these processes can be used in any combination and in any order.

Examples of synthetic base oils include poly-α-olefins or hydrides thereof, isobutene oligomers or hydrides thereof, isoparaffins, alkylbenzenes, alkylnaphthalenes, diesters (ditridecyl glutarate, di-2-ethylhexyl adipate, di-2-ethylhexyl azelate, diisodecyl adipate, ditridecyl adipate, di-2-ethylhexyl sebacate, and the like), polyol esters (trimethylolpropane caprylate, trimethylolpropane pelargonate, pentaerythritol 2-ethylhexanoate, pentaerythritol pelargonate, and the like), polyoxyalkylene glycols, dialkyldiphenyl ethers, polyphenyl ethers, and the like; among these, poly-α-olefins are preferable. Examples of poly-α-olefins include oligomers or cooligomers of α-olefins having 2 or more and 32 or less carbon atoms, preferably 6 or more and 16 or less carbon atoms (1-octene oligomer, decene oligomer, ethylene-propylene cooligomer, and the like) and hydrides thereof. These synthetic base oils may be used singly or in combination of two or more at any ratio.

The kinematic viscosity at 40° C. of the lubricating base oil is 140 to 350 $mm^2/s$. The kinematic viscosity at 40° C. of the lubricating base oil is preferably 150 $mm^2/s$ or more, more preferably 160 $mm^2/s$ or more, and even more preferably 170 $mm^2/s$ or more. When the kinematic viscosity at 40° C. of the lubricating base oil is 140 $mm^2/s$ or more, a lubricating oil composition having an excellent fatigue life can be easily obtained. Moreover, the kinematic viscosity at 40° C. of the lubricating base oil is preferably 320 $mm^2/s$ or less, more preferably 260 $mm^2/s$ or less, and even more preferably 220 $mm^2/s$ or less. When the kinematic viscosity at 40° C. of the lubricating base oil is 350 $mm^2/s$ or less, a lubricating oil composition having excellent antiwear property, cold flow property, and oxidation stability can be easily obtained.

The kinematic viscosity at 100° C. of the lubricating base oil is not particularly limited, but is preferably 10 $mm^2/s$ or more, more preferably 12 $mm^2/s$ or more, even more preferably 14 $mm^2/s$ or more, and particularly preferably 15 $mm^2/s$ or more. When the kinematic viscosity at 100° C. of the lubricating base oil is 10 $mm^2/s$ or more, a lubricating oil composition having a more satisfactory fatigue life can be easily obtained. Moreover, the kinematic viscosity at 100°

C. of the lubricating base oil is preferably 30 $mm^2/s$ or less, more preferably 25 $mm^2/s$ or less, and even more preferably 20 $mm^2/s$ or less. When the kinematic viscosity at 100° C. of the lubricating base oil is 30 $mm^2/s$ or less, a lubricating oil composition having more excellent antiwear property, cold flow property, and oxidation stability can be easily obtained.

The viscosity index of the lubricating base oil is not particularly limited, but is preferably 80 or more, more preferably 85 or more, and even more preferably 90 or more. When the viscosity index is 80 or more, a lubricating oil composition having more excellent viscosity characteristics at low to high temperatures can be easily obtained.

The lubricating base oil preferably contains a first lubricating base oil component having a kinematic viscosity at 40° C. of 200 to 600 $mm^2/s$ and a sulfur content of 0.3 to 0.9 mass %, and a second lubricating base oil component having a kinematic viscosity at 40° C. of less than 200 $mm^2/s$.

The first lubricating base oil component is not particularly limited, as long as the kinematic viscosity at 40° C. and the sulfur content satisfy the above requirements; however, a mineral oil base oil is preferable in terms of the ease of adjusting the sulfur content.

The kinematic viscosity at 40° C. of the first lubricating base oil component is preferably 200 to 600 $mm^2/s$. The kinematic viscosity at 40° C. of the first lubricating base oil component is more preferably 300 $mm^2/s$ or more, even more preferably 350 $mm^2/s$ or more, particularly preferably 400 $mm^2/s$ or more, and most preferably 450 $mm^2/s$ or more. Moreover, the kinematic viscosity at 40° C. of the first lubricating base oil component is more preferably 580 $mm^2/s$ or less, even more preferably 560 $mm^2/s$ or less, and particularly preferably 540 $mm^2/s$ or less. When the kinematic viscosity at 40° C. of the first lubricating base oil component is 200 $mm^2/s$ or more, or 600 $mm^2/s$ or less, a lubricating oil composition having more sufficient antiwear property and oxidation stability can be easily obtained.

The kinematic viscosity at 100° C. of the first lubricating base oil component is not particularly limited, but is preferably 20 to 40 $mm^2/s$. The kinematic viscosity at 100° C. of the first lubricating base oil component is more preferably 22 $mm^2/s$ or more, even more preferably 25 $mm^2/s$ or more, and particularly preferably 28 $mm^2/s$ or more. Moreover, the kinematic viscosity at 100° C. of the first lubricating base oil component is more preferably 38 $mm^2/s$ or less, even more preferably 35 $mm^2/s$ or less, and particularly preferably 33 $mm^2/s$ or less. When the kinematic viscosity at 100° C. of the first lubricating base oil component is 20 $mm^2/s$ or more, or 40 $mm^2/s$ or less, a lubricating oil composition having more sufficient antiwear property and oxidation stability can be easily obtained.

The sulfur content of the first lubricating base oil component is preferably 0.3 to 0.9 mass % based on the total amount of the first lubricating base oil component. The sulfur content of the first lubricating base oil component is more preferably 0.35 mass % or more, even more preferably 0.38 mass % or more, and particularly preferably 0.4 mass % or more. Moreover, the sulfur content of the first lubricating base oil component is more preferably 0.7 mass % or less, even more preferably 0.6 mass % or less, and particularly preferably 0.5 mass % or less. When the sulfur content of the first lubricating base oil component is 0.3 mass % or more, or 0.9 mass % or less, a lubricating oil composition having more sufficient antiwear property and oxidation stability can be easily obtained. The sulfur content of the first lubricating base oil component can be determined by, for example, ICP elemental analysis or the like.

The viscosity index of the first lubricating base oil component is not particularly limited, but is preferably 80 or more, more preferably 90 or more, and even more preferably 95 or more.

The pour point of the first lubricating base oil component is not particularly limited, but is preferably 0° C. or less, more preferably −5° C. or less, and even more preferably −10° C. or less.

The flash point of the first lubricating base oil component is not particularly limited, but is preferably 200° C. or more, more preferably 250° C. or more, and even more preferably 300° C. or more.

The content of the first lubricating base oil component is preferably 30 to 80 mass % based on the total amount of the base oil. The content of the first lubricating base oil component is more preferably 35 mass % more, even more preferably 37 mass % or more, and particularly preferably 40 mass % or more. When the content of the first lubricating base oil component is 30 mass % or more, a lubricating oil composition having a more excellent fatigue life can be easily obtained. Moreover, the content of the first lubricating base oil component is more preferably 75 mass % or less, even more preferably 72 mass % or less, and particularly preferably 70 mass % or less. When the content of the first lubricating base oil component is 80 mass % or less, a lubricating oil composition having more excellent antiwear property, cold flow property, and oxidation stability can be easily obtained.

The second lubricating base oil component may be a mineral oil base oil, a synthetic base oil, or a mixture of both oils, as long as the kinematic viscosity at 40° C. satisfies the above requirements.

The kinematic viscosity at 40° C. of the second lubricating base oil component is preferably less than 200 $mm^2/s$. The kinematic viscosity at 40° C. of the second lubricating base oil component is more preferably 150 $mm^2/s$ or less, even more preferably 130 $mm^2/s$ or less, particularly preferably 110 $mm^2/s$ or less, and most preferably 100 $mm^2/s$ or less. When the kinematic viscosity at 40° C. of the second lubricating base oil component is less than 200 $mm^2/s$, the effect of the combined use with the first lubricating base oil component tends to be more sufficient. Moreover, the kinematic viscosity at 40° C. of the second lubricating base oil component is preferably 5 $mm^2/s$ or more, more preferably 10 $mm^2/s$ or more, even more preferably 15 $mm^2/s$ or more, and particularly preferably 20 $mm^2/s$ or more, although it is not particularly limited thereto. When the kinematic viscosity at 40° C. of the second lubricating base oil component is 5 $mm^2/s$ or more, a lubricating oil composition having more excellent oil film-holding performance and evaporation properties can be easily obtained.

The kinematic viscosity at 100° C. of the second lubricating base oil component is not particularly limited, but is preferably less than 20 $mm^2/s$, more preferably 18 $mm^2/s$ or less, even more preferably 15 $mm^2/s$ or less, and particularly preferably 12 $mm^2/s$ or less. When the kinematic viscosity at 100° C. of the second lubricating base oil component is less than 20 $mm^2/s$, the effect of the combined use with the first lubricating base oil component tends to be more sufficient. Moreover, the kinematic viscosity at 100° C. of the second lubricating base oil component is preferably 1 $mm^2/s$ or more, more preferably 2 $mm^2/s$ or more, and even more preferably 3 $mm^2/s$ or more. When the kinematic viscosity at 100° C. of the second lubricating base oil component is 1 $mm^2/s$ or more, a lubricating oil composition having more excellent oil film-holding performance and evaporation properties can be easily obtained.

The sulfur content of the second lubricating base oil component is not particularly limited, but is preferably 0.30 mass % or less, and more preferably 0.25 mass % or less, based on the total amount of the second lubricating base oil component. The sulfur content of the second lubricating base oil component can be determined by, for example, ICP elemental analysis or the like.

The viscosity index of the second lubricating base oil component is not particularly limited, but is preferably 80 or more, more preferably 90 or more, and even more preferably 95 or more.

The content of the second lubricating base oil component is preferably 70 to 20 mass % based on the total amount of the base oil. The content of the second lubricating base oil component is more preferably 65 mass % or less, even more preferably 63 mass % or less, and particularly preferably 60 mass % or less. Moreover, the content of the second lubricating base oil component is more preferably 25 mass % or more, even more preferably 28 mass % or more, and particularly preferably 30 mass % or more.

[Component (B): A Copolymer of an α-Olefin and an Ester Monomer Having a Polymerizable Unsaturated Bond] The lubricating oil composition of the present embodiment comprises a copolymer (B) of an α-olefin and an ester monomer having a polymerizable unsaturated bond as a viscosity modifier. The combination of the component (A) with such a copolymer makes it possible to increase cold flow property.

The α-olefin is not particularly limited, but is preferably an α-olefin having 12 to 18 carbon atoms, and more preferably 14 to 16 carbon atoms. The α-olefin may be linear or branched. Due to the use of such an α-olefin, a copolymer having more sufficient compatibility with non-polar base oils can be obtained.

Examples of the α-olefin include 1-dodecene, 1-tetradecene, 1-hexadecene, 1-octadecene, and the like. These may be used singly or in combination of two or more.

The ester monomer having a polymerizable unsaturated bond is not particularly limited, as long as it is a compound having a polymerizable unsaturated bond and an ester bond; however, the ester monomer having a polymerizable unsaturated bond is preferably an α,β-ethylenically unsaturated dicarboxylic acid diester, which is a diester of unsaturated dicarboxylic acid in which the α and β carbons of at least one carboxy group form an ethylenically unsaturated bond (i.e., a C=C double bond). The term "α,β-ethylenically unsaturated dicarboxylic acid" mentioned herein refers to a concept including, not only compounds in which the α and β carbons of both carboxy groups form an ethylenically unsaturated bond, and the α,β-ethylenically unsaturated bond is present in the main chain (e.g., maleic acid, fumaric acid, citraconic acid, mesaconic acid, and the like), but also compounds in which the α and β carbons of only one carboxy group form an ethylenically unsaturated bond (e.g., glutaconic acid, and the like), as well as a concept including compounds having an α,β-ethylenically unsaturated bond in the side chain (e.g., itaconic acid, and the like).

The structure of the copolymer of an α-olefin and an ester monomer having a polymerizable unsaturated bond is not particularly limited. Furthermore, the production method is also not particularly limited, and those produced by known methods can be used.

The weight average molecular weight of the copolymer of an α-olefin and an ester monomer having a polymerizable unsaturated bond is preferably 9000 or more, more preferably 10000 or more, and even more preferably 11000 or more, although it is not particularly limited thereto. Moreover, the weight average molecular weight of the copolymer is preferably 15000 or less, more preferably 14000 or less, and even more preferably 13000 or less, although it is not particularly limited thereto. When the weight average molecular weight of the copolymer is 9000 or more, or 15000 or less, a lubricating oil composition having more excellent cold flow property can be easily obtained.

In the present specification, the weight average molecular weight refers to a weight average molecular weight in terms of standard polystyrene measured by Waters 150-C ALC/GPC apparatus with two GMHHR-M (7.8 mm ID×30 cm) columns (produced by Tosoh Corporation) used to be connected in series and tetrahydrofuran as a solvent using a differential refractometer (RI) detector under the following conditions: temperature: 23° C., flow rate: 1 mL/min, sample concentration: 1 mass %, and sample injection amount: 75 μL.

The content of the copolymer of an α-olefin and an ester monomer having a polymerizable unsaturated bond is preferably 0.5 mass % or more, more preferably 1 mass % or more, even more preferably 2 mass % or more, and particularly preferably 2.5 mass % or more, based on the total amount of the composition. When the content of the copolymer is 0.5 mass % or more, a lubricating oil composition having more excellent cold flow property can be easily obtained. Moreover, the content of the copolymer is preferably 15 mass % or less, more preferably 13 mass % or less, and even more preferably 11 mass % or less, although it is not particularly limited thereto. When the content of the copolymer is 15 mass % or less, a lubricating oil composition having a more excellent fatigue life can be easily obtained.

[Component (C): A Performance Additive Containing Phosphorus and Sulfur]

The lubricating oil composition of the present embodiment comprises a performance additive (C) containing phosphorus and sulfur.

The performance additive containing phosphorus and sulfur may be one member selected from the group consisting of a combination of a first additive containing phosphorus as a constituent element but not containing sulfur, and a second additive containing sulfur as a constituent element but not containing phosphorus; a third additive containing both phosphorus and sulfur as constituent elements; a combination of the first additive and the third additive; a combination of the second additive and the third additive; and a combination of the first additive, the second additive, and the third additive. The combined use of the component (C) with the components (A) and (B) mentioned above makes it possible to improve the oil film-holding performance and extreme-pressure properties of the lubricating oil composition.

The first additive is an additive containing phosphorus as a constituent element but not containing sulfur. The first additive is not particularly limited, as long as it satisfies the above requirements. Examples thereof include phosphorus-based extreme-pressure agents such as phosphorous acid esters (phosphites), phosphates, amine salts thereof; metal salts thereof, derivatives thereof, and the like.

The second additive is an additive containing sulfur as a constituent element but not containing phosphorus. The second additive is not particularly limited, as long as it satisfies the above requirements. Examples thereof include anti-wear agents (or extreme-pressure agents), such as dithiocarbamate, zinc dithiocarbamate, molybdenum dithiocarbamate (MoDTC), disulfides, polysulfides, olefin sulfides, and sulfurized oils and fats; metal-based detergents, such as sulfonate-based detergents (normal salts, basic normal salts, and overbased salts of alkali metal or alkaline earth metal); metal deactivators, such as mercaptobenzothiazole, 2-(alkyldithio)benzimidazole, and β-(o-carboxybenzylthio)propionitrile; corrosion inhibitors, such as thiadiazole-based compounds; rust inhibitors, such as petroleum sulfonate, alkylbenzene sulfonate, and dinonylnaphthalene sulfonate; and the like. The second additive preferably contains thiadiazole.

The structure of thiadiazole is not particularly limited. Examples of the thiadiazole include a 1,3,4-thiadiazole compound represented by Formula (3) below, a 1,2,4-thiadiazole compound represented by Formula (4), a 1,2,3-thiadiazole compound represented by Formula (5), and the like.

[Chemical Formula 1]

(3)

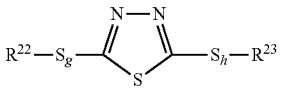

(4)

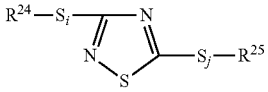

(5)

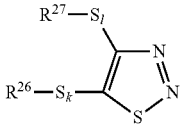

In Formulas (3) to (5), $R^{22}$, $R^{23}$, $R^{24}$, $R^{25}$, $R^{26}$, and $R^{27}$ each independently represent a hydrogen atom or a hydrocarbon group having 1 to 30 carbon atoms, and g, h, i, j, k, and l each independently represent an integer of 0 to 8. Examples of the hydrocarbon group having 1 to 30 carbon atoms include an alkyl group, a cycloalkyl group, an alkylcycloalkyl group, an alkenyl group, an aryl group, an alkylaryl group, an arylalkyl group, and the like.

The content of thiadiazole contained in the performance additive containing phosphorus and sulfur is not particularly limited, but is preferably 0.01 mass/o or more, more preferably 0.015 mass % or more, even more preferably 0.02 mass % or more, and particularly preferably 0.025 mass % or more, in terms of sulfur element, based on the total amount of the composition. Moreover, the content of thiadiazole is preferably 0.1 mass % or less, more preferably 0.09 mass % or less, even more preferably 0.08 mass % or less, and particularly preferably 0.07 mass % or less. The content of thiadiazole (in terms of sulfur element) contained in the performance additive based on the total amount of the composition can be determined, for example, in such a manner that the content of thiadiazole (in terms of sulfur element) based on the total amount of the performance additive is previously analyzed by ICP elemental analysis or the like, and the content of thiadiazole (value in terms of sulfur element) is calculated from the analytical value and the amount of the performance additive added.

The third additive is an additive containing both phosphorus and sulfur as constituent elements. The third additive is not particularly limited, as long as it satisfies the above requirements. Examples thereof include sulfur-phosphorus-based extreme-pressure agents such as zinc dialkyldithiophosphate (ZnDTP), thiophosphites, dithiophosphites, trithiophosphites, thiophosphates, dithiophosphates, trithiophosphates, amine salts thereof, ammonium salts thereof, metal salts thereof, derivatives thereof and the like.

The performance additive containing phosphorus and sulfur is preferably a combination of the first additive and the second additive.

The content of the performance additive containing phosphorus and sulfur preferably satisfies the requirements represented by the following Formulas (1) and (2):

$$C_P \geq 0.05 \quad (1)$$

$$7 \leq (C_S/C_P) \leq 20 \quad (2)$$

[wherein $C_P$ represents the content of phosphorus contained in the performance additive, $C_S$ represents the content of sulfur contained in the performance additive, and $C_P$ and $C_S$ each represent an amount (mass %) in terms of phosphorus or sulfur element based on the total amount of the composition.]

$C_P$ is preferably 0.05 or more, more preferably 0.06 or more, and even more preferably 0.08 or more. When $C_P$ is 0.05 or more, a lubricating oil composition having more excellent antiwear property, seizure resistance, and fatigue life can be easily obtained. Moreover, $C_P$ is preferably 0.30 or less, and more preferably 0.20 or less, although it is not particularly limited thereto. $C_P$ can be determined, for example, in such a manner that the phosphorus content based on the total amount of the performance additive is previously analyzed by ICP elemental analysis or the like, and $C_P$ is calculated from the analytical value and the amount of the performance additive added.

$C_S$ is preferably 1 or more, more preferably 1.1 or more, even more preferably 1.2 or more, and particularly preferably 1.3 or more, although it is not particularly limited thereto. Moreover, $C_S$ is preferably 2 or less, more preferably 1.9 or less, even more preferably 1.8 or less, and particularly preferably 1.7 or less, although it is not particularly limited thereto. $C_S$ can be determined, for example, in such a manner that the sulfur content based on the total amount of the performance additive is previously analyzed by ICP elemental analysis or the like, and $C_S$ is calculated from the analytical value and the amount of the performance additive added.

$(C_S/C_P)$ is preferably 7 or more, more preferably 8 or more, even more preferably 9 or more, and particularly preferably 10 or more. When $(C_S/C_P)$ is 7 or more, a lubricating oil composition having more excellent seizure resistance and fatigue life can be easily obtained. Moreover, $(C_S/C_P)$ is preferably 20 or less, more preferably 19 or less, and even more preferably 18 or less. When $(C_S/C_P)$ is 20 or less, a lubricating oil composition having more excellent antiwear property, fatigue life, and oxidation stability can be easily obtained.

[Component (D): A Poly(Meth)Acrylate Pour-Point Depressant]

The lubricating oil composition of the present embodiment comprises a poly(meth)acrylate pour-point depressant (D). The use of such a pour-point depressant in combination with the components (A), (B), and (C) makes it possible to increase cold flow property and to reduce agitation loss.

Examples of the poly(meth)acrylate pour-point depressant include copolymers of at least one monomer selected from various acrylates and methacrylates, or hydrogenated products thereof, and the like.

The weight average molecular weight of the pour-point depressant is preferably 10000 or more, more preferably 20000 or more, and even more preferably 40000 or more, although it is not particularly limited thereto. Moreover, the weight average molecular weight of the pour-point depressant is preferably 100000 or less, more preferably 80000 or less, and even more preferably 60000 or less, although it is not particularly limited thereto.

The content of the pour-point depressant is preferably 0.1 mass % or more, and more preferably 0.2 mass % or more, based on the total amount of the composition, although it is not particularly limited thereto. When the content of the pour-point depressant is 0.1 mass % or more, a lubricating oil composition having more excellent cold flow property can be easily obtained. Moreover, the content of the pour-point depressant is preferably 1.0 mass % or less, and more preferably 0.7 mass % or less, although it is not particularly limited thereto.

[Lubricating Oil Composition]

The kinematic viscosity at 140° C. of the lubricating oil composition of the present embodiment is preferably 6.0 $mm^2/s$ or more, more preferably 6.3 $mm^2/s$ or more, even more preferably 6.5 $mm^2/s$ or more, and particularly preferably 6.7 $mm^2/s$ or more. When the kinematic viscosity at 140° C. of the lubricating oil composition is 6.0 $mm^2/s$ or more, a lubricating oil composition having a more excellent fatigue life can be easily obtained. Moreover, the kinematic viscosity at 140° C. of the lubricating oil composition is preferably 15 $mm^2/s$ or less, more preferably 10 $mm^2/s$ or less, and even more preferably 8 $mm^2/s$ or less, although it is not particularly limited thereto. When the kinematic viscosity at 140° C. of the lubricating oil composition is 15 $mm^2/s$ or less, a lubricating oil composition having more excellent antiwear property, cold flow property, and oxidation stability can be easily obtained.

The lubricating oil composition of the present embodiment may contain any additives generally used for lubricating oils, depending on its purpose. Examples of such additives include metal-based detergents, ashless dispersants, antioxidants, corrosion inhibitors, rust inhibitors, demulsifiers, metal deactivators, antifoaming agents, friction modifiers, and the like.

Examples of metal-based detergents include salicylate-based detergents, phenate-based detergents, and the like. Any of normal salts, basic normal salts, and overbased salts of alkali metal or alkaline earth metal can be mixed. When used, any one or more members selected from these can be mixed.

As ashless dispersants, any ashless dispersants used for lubricating oils can be used. Examples thereof include mono- or bis-succinimide having at least one linear or branched alkyl or alkenyl group having 40 or more and 400 or less carbon atoms in the molecule, benzylamine having at least one alkyl or alkenyl group having 40 or more and 400 or less carbon atoms in the molecule, polyamine having at least one alkyl or alkenyl group having 40 or more and 400 or less carbon atoms in the molecule, and modified products thereof with a boron compound, carboxylic acid, phosphoric acid, and the like. When used, any one or more members selected from these can be mixed.

Examples of antioxidants include ashless antioxidants such as phenol-based, amine-based, and the like, and metal-based antioxidants such as copper-based, molybdenum-based, and the like. Specifically, examples of phenol-based ashless antioxidants include 4,4'-methylenebis(2,6-di-tert-butylphenol), 4,4'-bis(2,6-di-tert-butylphenol), and the like. Examples of amine-based ashless antioxidants include phenyl-α-naphthylamine, alkylphenyl-α-naphthylamine, dialkyl diphenylamine, and the like.

Examples of corrosion inhibitors include benzotriazole-based compounds, tolyltriazole-based compounds, imidazole-based compounds, and the like.

Examples of rust inhibitors include alkenyl succinate, polyhydric alcohol esters, and the like.

Examples of demulsifiers include polyalkylene glycol-based nonionic surfactants, such as polyoxyethylene alkyl ether, polyoxyethylene alkyl phenyl ether, polyoxyethylene alkyl naphthyl ether, and the like.

Examples of metal deactivators include imidazoline, pyrimidine derivatives, benzotriazole or derivatives thereof, and the like.

Examples of antifoaming agents include silicone oil having a kinematic viscosity at 25° C. of 1000 $mm^2/s$ or more and 100000 $mm^2/s$ or less, alkenyl succinic acid derivatives, esters of polyhydroxy aliphatic alcohols and long-chain fatty acids, esters of methyl salicylate and o-hydroxybenzyl alcohols, and the like.

Examples of friction modifiers include ashless friction modifiers. Any compound generally used as an ashless friction modifier for lubricating oils can be used. Examples thereof include amine-based, imide-based, fatty acid ester-based, fatty acid amide-based, fatty acid-based, aliphatic alcohol-based, and aliphatic ether-basedashless friction modifiers having at least one hydrocarbon group, preferably alkyl or alkenyl group, having 6 to 30 carbon atoms, and particularly at least one linear alkyl or alkenyl group having 6 to 30 carbon atoms, in the molecule.

When these additives are included in the lubricating oil composition according to the present embodiment, the content of each additive is preferably 0.01 to 20 mass % based on the total amount of the composition.

EXAMPLES

The present invention is described in more detail below with reference to Examples; however, the present invention is not limited to the Examples.

Examples 1 to 14 and Comparative Examples 1 to 5

As shown in Tables 1 and 2, the lubricating oil compositions of Examples 1 to 14 and Comparative Examples 1 to 5 were each prepared. The obtained lubricating oil compositions were measured for antiwear property, seizure resistance, fatigue life, cold flow property, and oxidation stability, and the results were also shown in Tables 1 and 2.

The details of each component shown in Tables 1 and 2 are as follows.

[Component (A)]

<First Lubricating Base Oil Component>

Base oil A-1-1: solvent-refined mineral oil [group I, 40° C. kinematic viscosity: 478.3 $mm^2/s$, 100° C. kinematic viscosity: 31.6 $mm^2/s$, viscosity index: 97, sulfur content: 0.48 mass %, pour point: −12.8° C., and flash point: 315° C.]

Base oil A-1-2: solvent-refined mineral oil [group I, 40° C. kinematic viscosity: 506.8 $mm^2/s$, 100° C. kinematic viscosity: 32.30 $mm^2/s$, viscosity index: 95, sulfur content: 0.42 mass %, pour point: −10.0° C., and flash point: 314° C.]

<Second Lubricating Base Oil Component>

Base oil A-2-1: solvent-refined mineral oil [group I, 40° C. kinematic viscosity: 93.31 $mm^2/s$, 100° C. kinematic viscosity: 10.63 $mm^2/s$, viscosity index: 96, sulfur content: 0.21 mass %, pour point: −12.5° C., and flash point: 266° C.]

Base oil A-2-2: solvent-refined mineral oil [group I, 40° C. kinematic viscosity: 22.7 $mm^2/s$, 100° C. kinematic viscosity: 4.4 $mm^2/s$, viscosity index: 102, sulfur content: 0.14 mass %, pour point: −14.9° C., and flash point: 220° C.]

Base oil A-2-3: hydrorefined mineral oil [group II, 40° C. kinematic viscosity: 33.97 $mm^2/s$, 100° C. kinematic viscosity: 6.208 $mm^2/s$, viscosity index: 133, sulfur content: less than 10 mass ppm, pour point: −14.9° C., flash point: 220° C., ° % $C_P$ (paraffin content ratio): 80.6, % $C_N$ (naphthene content ratio): 19.4, and % $C_A$ (aromatic content ratio): 0]

Base oil A-2-4: poly-α-olefin [group IV, 40° C. kinematic viscosity: 31 $mm^2/s$, 100° C. kinematic viscosity: 5.8 $mm^2/s$, viscosity index: 138, pour point: −57° C., and flash point: 246° C.]

[Component (B)]

Copolymer B-1: a copolymer of an α-olefin and an ester monomer having a polymerizable unsaturated bond [α-olefin: 12 to 18 carbon atoms, ester monomer having a polymerizable unsaturated bond: α,β-ethylenically unsaturated dicarboxylic acid diester, and weight average molecular weight: 12800]

[Component (C)]

Performance additive C-1: an additive package (boron-containing succinimide, phosphate ester, polysulfide, thiadiazole (amount in terms of sulfur: 0.4 mass %, based on the total amount of the additive package), an amine-based friction modifier, an amine-based antioxidant, and an antifoaming agent) [amount in terms of phosphorus element: 1.40 mass %, and amount in terms of sulfur element: 22.9 mass %, based on the total amount of the additive package]

Performance additive C-2: an additive package (a boron-based dispersant, phosphite ester, phosphate ester, polysulfide, thiadiazole (amount in terms of sulfur: 0.9 mass %, based on the total amount of the additive package), an amine-based friction modifier, an amine-based antioxidant, and an antifoaming agent) [amount in terms of phosphorus element: 1.79 mass %, and amount in terms of sulfur element: 18.1 mass %, based on the total amount of the additive package]

Performance additive C-3: di(n-butyl) phosphite [amount in terms of phosphorus element 15.5 mass %]

Performance additive C-4: polysulfide [amount in terms of sulfur element: 45.8 mass %]

[Component (D)]

Pour-point depressant D-1: a poly(meth)acrylate pour-point depressant [weight average molecular weight: 46000]

The amount in terms of sulfur element in the first lubricating base oil component and the second lubricating base oil component, and the amount in terms of phosphorus element and the amount in terms of sulfur element in the performance additives were determined by ICP elemental analysis.

(1) Antiwear Property Test

The welding load (WL) of each lubricating oil composition at 1800 rpm was measured according to ASTM D 2596 using a high-speed four-ball tester. In this test, a higher welding load (e.g., 2452 N or more) means superior antiwear property.

Further, the Shell four-ball test (ASTM D4172) was conducted under the following conditions to measure the wear scar diameter (mm), and antiwear property was evaluated. In this test, a smaller wear scar diameter (e.g., 0.5 mm or less) means superior antiwear property.

Load: 392 N

Number of rotations: 1200 rpm

Temperature: 80° C.

Test time: 30 minutes (2) Seizure Resistance Test

Seizure load was measured using the Falex test machine according to ASTM D3233, and seizure resistance was evaluated. The seizure resistance indicates the extreme-pressure properties of steels. The test conditions are shown below. In this test, a higher seizure load (e.g., 4000 N or more) means superior seizure resistance.

Temperature: 110° C.

Number of rotations: 290 rpm (3) Fatigue Life Test (a) High-Temperature Rolling Fatigue Test The fatigue life of a gear until pitching occurred was evaluated by the Unisteel rolling fatigue test under the following conditions. The test conditions are shown below. In this test, a larger numerical value (e.g., 1000 minutes or more) means a longer fatigue life.

Test piece: thrust needle

Surface pressure: 2 GPa

Oil temperature: 120° C.

Number of rotations: 1410 rpm (b) FZG Gear Test

Operation was carried out under the following conditions using the FZG test machine, and the fatigue life of a gear until pitching occurred in the gear was evaluated. In this test, a larger numerical value (e.g., 17 hours or more) means a longer fatigue life.

Gear: C gear

Load stage: 12

Oil temperature: 120° C.

Number of rotations: 650 rpm (4) Cold Flow Property Test

The pour point was measured according to JIS K 2269-1987, and cold flow property was evaluated. In this test, a lower pour point (e.g., −20° C. or less) means superior cold flow property.

(5) Oxidation Stability Test

A test was conducted according to JIS K 2514 4 (internal combustion engine lubricating oil oxidation stability test method) under the following conditions to measure the increase in the acid value. In this test, a less acid value increase (e.g., 2.5 mgKOH/g or less) means superior oxidation stability.

Temperature: 135° C.

Test time: 96 hours

TABLE 1

| | | Ex. 1 | Ex. 2 | Ex. 3 | Ex. 4 | Ex. 5 |
|---|---|---|---|---|---|---|
| Component (A): lubricating base oil First lubricating base oil component (based on the total amount of the base oil) | | | | | | |
| Base oil A-1-1 | mass % | (47) | — | (67) | (69) | (47) |
| Base oil A-1-2 | mass % | — | (46) | — | — | — |

TABLE 1-continued

| | | Ex. 1 | Ex. 2 | Ex. 3 | Ex. 4 | Ex. 5 |
|---|---|---|---|---|---|---|
| Second lubricating base oil component (based on the total amount of the base oil) | | | | | | |
| Base oil A-2-1 | mass % | (53)_ | (54) | — | — | (53) |
| Base oil A-2-2 | mass % | — | — | — | — | — |
| Base oil A-2-3 | mass % | — | — | (33) | — | — |
| Base oil A-2-4 | mass % | — | — | — | (31) | — |
| Kinematic viscosity of (A) | | | | | | |
| (40° C.) | $mm^2/s$ | 189 | 190 | 170 | 173 | 189 |
| (100° C.) | $mm^2/s$ | 17 | 17 | 17 | 17 | 17 |
| Viscosity index of (A) | | 95 | 94 | 104 | 103 | 95 |
| Base oil (based on the total amount of the composition) | | | | | | |
| Component (A): lubricating base oil | | Balance | Balance | Balance | Balance | Balance |
| Additives (based on the total amount of the composition) | | | | | | |
| Component (B): copolymer B-1 | mass % | 3.0 | 3.0 | 3.0 | 3.0 | 3.0 |
| Component (C): | | | | | | |
| performance additive C-1 | mass % | 7.0 | 7.0 | 7.0 | 7.0 | — |
| performance additive C-2 | mass % | — | — | — | — | 7.5 |
| performance additive C-3 | mass % | — | — | — | — | — |
| performance additive C-4 | mass % | — | — | — | — | — |
| $C_P$ (based on the total amount of the composition) | mass % | 0.10 | 0.10 | 0.10 | 0.10 | 0.13 |
| $C_S$ (based on the total amount of the composition) | mass % | 1.60 | 1.60 | 1.60 | 1.60 | 1.36 |
| $C_S/C_P$ | | 16.4 | 16.4 | 16.4 | 16.4 | 10.1 |
| Thiadiazole content (in terms of sulfur element, based on the total amount of the composition) | mass % | 0.028 | 0.028 | 0.028 | 0.028 | 0.068 |
| Component (D): pour-point depressant D-1 | mass % | 0.2 | 0.2 | 0.2 | 0.2 | 0.2 |
| Lubricating oil composition | | | | | | |
| Kinematic viscosity (140° C.) | $mm^2/s$ | 6.9 | 6.9 | 6.9 | 7.0 | 6.9 |
| Wear resistance test WL | N | 4903 | 3923 | 3923 | 3923 | 3089 |
| Wear test wear scar diameter | mm | 0.34 | 0.38 | 0.31 | 0.31 | 0.42 |
| Seizure resistance test | N | 4804 | 5872 | 5027 | 5027 | 5692 |
| High-temperature rolling fatigue test | min | 1235 | 1354 | 1421 | 1568 | 1289 |
| FZG gear test | hr | 20 | 20 | 18 | 22 | 18 |
| Low-temperature fluidity test pour point | ° C. | −25.0 | −25.0 | −30.0 | −35.0 | −25.0 |
| Oxidation stability | mgKOH/g | 2.0 | 2.1 | 1.8 | 1.8 | 2.2 |

| | | Ex. 6 | Ex. 7 | Ex. 8 | Ex. 9 | Ex. 10 |
|---|---|---|---|---|---|---|
| Component (A): lubricating base oil | | | | | | |
| First lubricating base oil component (based on the total amount of the base oil) | | | | | | |
| Base oil A-1-1 | mass % | — | (67) | (69) | (55) | (44) |
| Base oil A-1-2 | mass % | (46) | — | — | — | — |
| Second lubricating base oil component (based on the total amount of the base oil) | | | | | | |
| Base oil A-2-1 | mass % | (54) | — | — | (45) | (56) |
| Base oil A-2-2 | mass % | — | — | — | — | — |
| Base oil A-2-3 | mass % | — | (33) | — | — | — |
| Base oil A-2-4 | mass % | — | — | (31) | — | — |
| Kinematic viscosity of (A) | | | | | | |
| (40° C.) | $mm^2/s$ | 190 | 170 | 173 | 216 | 180 |
| (100° C.) | $mm^2/s$ | 17 | 17 | 17 | 19 | 16 |
| Viscosity index of (A) | | 94 | 104 | 103 | 95 | 95 |
| Base oil (based on the total amount of the composition) | | | | | | |
| Component (A): lubricating base oil | | Balance | Balance | Balance | Balance | Balance |

TABLE 1-continued

| | | Ex. 1 | Ex. 2 | Ex. 3 | Ex. 4 | Ex. 5 |
|---|---|---|---|---|---|---|
| Additives (based on the total amount of the composition) | | | | | | |
| Component (B): copolymer B-1 | mass % | 3.0 | 3.0 | 3.0 | 1.0 | 5.0 |
| Component (C): | | | | | | |
| performance additive C-1 | mass % | — | — | — | 7.0 | 7.0 |
| performance additive C-2 | mass % | 7.5 | 7.5 | 7.5 | — | — |
| performance additive C-3 | mass % | — | — | — | — | — |
| performance additive C-4 | mass % | — | — | — | — | — |
| $C_P$ (based on the total amount of the composition) | mass % | 0.13 | 0.13 | 0.13 | 0.10 | 0.10 |
| $C_S$ (based on the total amount of the composition) | mass % | 1.36 | 1.36 | 1.36 | 1.60 | 1.60 |
| $C_S/C_P$ | | 10.1 | 10.1 | 10.1 | 16.4 | 16.4 |
| Thiadiazole content (in terms of sulfur element, based on the total amount of the composition) | mass % | 0.068 | 0.068 | 0.068 | 0.028 | 0.028 |
| Component (D): pour-point depressant D-1 | mass % | 0.2 | 0.2 | 0.2 | 0.2 | 0.2 |
| Lubricating oil composition | | | | | | |
| Kinematic viscosity (140° C.) | $mm^2/s$ | 6.9 | 6.9 | 7.0 | 6.9 | 6.9 |
| Wear resistance test WL | N | 3923 | 3089 | 3923 | 3923 | 4903 |
| Wear test wear scar diameter | mm | 0.41 | 0.39 | 0.40 | 0.41 | 0.35 |
| Seizure resistance test | N | 6183 | 5293 | 4982 | 4804 | 5071 |
| High-temperature rolling fatigue test | min | 1402 | 1487 | 1499 | 1218 | 1536 |
| FZG gear test | hr | 18 | 18 | 20 | 18 | 22 |
| Low-temperature fluidity test pour point | ° C. | −25.0 | −30.0 | −32.5 | −25.0 | −25.0 |
| Oxidation stability | mgKOH/g | 2.1 | 2.0 | 1.9 | 2.0 | 2.1 |

| | | Ex. 11 | Ex. 12 | Ex. 13 | Ex. 14 |
|---|---|---|---|---|---|
| Component (A): lubricating base oil First lubricating base oil component (based on the total amount of the base oil) | | | | | |
| Base oil A-1-1 | mass % | (35) | (47) | (47) | (47) |
| Base oil A-1-2 | mass % | — | — | — | — |
| Second lubricating base oil component (based on the total amount of the base oil) | | | | | |
| Base oil A-2-1 | mass % | (65) | (53) | (53) | (53) |
| Base oil A-2-2 | mass % | — | — | — | — |
| Base oil A-2-3 | mass % | — | — | — | — |
| Base oil A-2-4 | mass % | — | — | — | — |
| Kinematic viscosity of (A) | | 156 | 189 | 189 | 189 |
| (40° C.) | $mm^2/s$ | 156 | 189 | 189 | 189 |
| (100° C.) | $mm^2/s$ | 15 | 17 | 17 | 17 |
| Viscosity index of (A) | | 95 | 95 | 95 | 95 |
| Base oil (based on the total amount of the composition) | | | | | |
| Component (A): lubricating base oil | | Balance | Balance | Balance | Balance |
| Additives (based on the total amount of the composition) | | | | | |
| Component (B): copolymer B-1 | mass % | 10.0 | 3.0 | 3.0 | 3.0 |
| Component (C): | | | | | |
| performance additive C-1 | mass % | | | | |
| performance additive C-2 | mass % | 7.0 | 7.0 | — | 7.0 |
| performance additive C-3 | mass % | — | — | 7.5 | — |
| performance additive C-4 | mass % | — | — | 0.26 | — |
| $C_P$ (based on the total amount of the composition) | mass % | — | — | — | 0.70 |
| $C_S$ (based on the total amount of the composition) | mass % | 0.10 | 0.10 | 0.17 | 0.10 |
| $C_S/C_P$ | | 1.60 | 1.60 | 1.36 | 1.92 |
| Thiadiazole content (in terms of sulfur element, based on the total amount of the composition) | mass % | 16.4 | 16.4 | 7.8 | 19.6 |
| Component (D): pour-point depressant D-1 | mass % | 0.028 | 0.028 | 0.068 | 0.028 |
| | | 0.2 | 0.5 | 0.2 | 0.2 |

TABLE 1-continued

| | | Ex. 1 | Ex. 2 | Ex. 3 | Ex. 4 | Ex. 5 |
|---|---|---|---|---|---|---|
| Lubricating oil composition | | | | | | |
| Kinematic viscosity (140° C.) | $mm^2/s$ | 7.1 | 7.0 | 6.9 | 6.9 | |
| Wear resistance test WL | N | 3923 | 3923 | 3923 | 3923 | |
| Wear test wear scar diameter | mm | 0.40 | 0.37 | 0.33 | 0.44 | |
| Seizure resistance test | N | 5027 | 4849 | 4404 | 4493 | |
| High-temperature rolling fatigue test | min | 1488 | 1201 | 1103 | 1130 | |
| FZG gear test | hr | 20 | 20 | 22 | 18 | |
| Low-temperature fluidity test pour point | ° C. | −25.0 | −27.5 | −25.0 | −25.0 | |
| Oxidation stability | mgKOH/g | 2.1 | 2.1 | 2.0 | 2.3 | |

TABLE 2

| | | Comp. Ex. 1 | Comp. Ex. 2 | Comp. Ex. 3 | Comp. Ex. 4 | Comp. Ex. 5 |
|---|---|---|---|---|---|---|
| Component (A): lubricating base oil First lubricating base oil component (based on the total amount of the base oil) | | | | | | |
| Base oil A-1-1 | mass % | (25) | (90) | (47) | (47) | (60) |
| Base oil A-1-2 | mass % | — | — | — | — | — |
| Second lubricating base oil component (based on the total amount of the base oil) | | | | | | |
| Base oil A-2-1 | mass % | (75) | (10) | (53) | (53) | — |
| Base oil A-2-2 | mass % | — | — | — | — | (40) |
| Base oil A-2-3 | mass % | — | — | — | — | — |
| Base oil A-2-4 | mass % | — | — | — | — | — |
| Kinematic viscosity of (A) | | | | | | |
| (40° C.) | $mm^2/s$ | 134 | 397 | 189 | 189 | 111 |
| (100° C.) | $mm^2/s$ | 14 | 28 | 17 | 17 | 12 |
| Viscosity index of (A) | | 95 | 96 | 95 | 95 | 100 |
| Base oil (based on the total amount of the composition) | | | | | | |
| Component (A): lubricating base oil | | Balance | Balance | Balance | Balance | Balance |
| Additives (based on the total amount of the composition) | | | | | | |
| Component (B): copolymer B-1 | mass % | 12.0 | 3.0 | — | 0.3 | 3.0 |
| Component (C): | | | | | | |
| performance additive C-1 | mass % | 7.0 | 7.0 | 7.0 | 7.0 | 7.0 |
| Performance additive C-2 | mass % | — | — | — | — | — |
| performance additive C-3 | mass % | — | — | — | — | — |
| performance additive C-4 | mass % | — | — | — | — | — |
| $C_P$ (based on the total amount of the composition) | mass % | 0.10 | 0.10 | 0.10 | 0.10 | 0.10 |
| $C_S$ (based on the total amount of the composition) | mass % | 1.60 | 1.60 | 1.60 | 1.60 | 1.60 |
| $C_S/C_P$ | | 16.4 | 16.4 | 16.4 | 16.4 | 16.4 |
| Thiadiazole content (in terms of sulfur element, based on the total amount of the composition) | mass % | 0.028 | 0.028 | 0.028 | 0.028 | 0.028 |
| Component (D): pour-point depressant D-1 | mass % | 0.2 | 0.2 | 0.2 | — | 0.2 |
| Lubricating oil composition | | | | | | |
| Kinematic viscosity (140° C.) | $mm^2/s$ | 7.0 | 10.0 | 6.9 | 6.9 | 5.5 |
| Wear resistance test WL | N | 3923 | 4903 | 3089 | 3923 | 3923 |
| Wear test wear scar diameter | mm | 0.41 | 0.53 | 0.46 | 0.40 | 0.46 |
| Seizure resistance test | N | 4938 | 6317 | 4537 | 4804 | 5427 |
| High-temperature rolling fatigue test | min | 984 | 1312 | 987 | 1241 | 875 |
| FZG gear test | hr | 16 | 22 | 16 | 20 | 14 |
| Low-temperature fluidity test pour point | ° C. | −25.0 | −17.5 | −25.0 | −12.5 | −27.5 |
| Oxidation stability | mgKOH/g | 2.0 | 2.6 | 2.0 | 2.0 | 2.0 |

As shown in Tables 1 and 2, it was revealed that, compared with the lubricating oil compositions of Comparative Examples 1 to 5, the lubricating oil composition of Examples 1 to 14 were superior in cold flow property, antiwear property, oxidation stability, and fatigue life in a good balance.

The invention claimed is:

1. A lubricating oil composition for gear oil, comprising:

a lubricating base oil having a kinematic viscosity at 40° C. of 140 to 350 $mm^2/s$ wherein the content of the lubricating base oil is 82.8 mass % or more based on the total amount of the lubricating oil composition, wherein the lubricating base oil consists of:

a first lubricating base oil component having a kinematic viscosity at 40° C. of 200 to 600 $mm^2/s$ and a sulfur content of 0.3 to 0.9 mass %, and a second lubricating base oil component having a kinematic viscosity at 40° C. of less than 200 $mm^2/s$, and wherein the content of the first lubricating base oil component is 30 to 80 mass %, and the content of the second lubricating base oil component is 70 to 20 mass %, based on the total amount of the base oil;

a copolymer of an α-olefin having 12 to 18 carbon atoms and an ester monomer having a polymerizable unsaturated bond, wherein the content of the copolymer is 0.5 to 15 mass % based on the total amount of the lubricating oil composition, and the weight average molecular weight of the copolymer is 9000 to 15000;

a performance additive comprising phosphorus and sulfur, wherein the performance additive is a combination of a first additive containing phosphorus but not containing sulfur and a second additive containing sulfur but not containing phosphorus, wherein the first additive is phosphorous acid esters or phosphates, the second additive is polysulfides and thiadiazole-based compounds, and the content of the thiadiazole is 0.01 to 0.1 mass % in terms of sulfur element based on the total amount of the composition; and a poly(meth)acrylate pour-point depressant, wherein the content of the poly(meth)acrylate pour-point depressant is 0.1 to 1.0 mass % based on the total amount of the lubricating oil composition;

wherein the content of the performance additive satisfies requirements represented by the following formulas (1), (2), and (3):

$$0.10 \leq C_P \leq 0.20 \quad (1)$$

$$7 \leq (C_S/C_P) \leq 20 \quad (2)$$

$$1.36 \leq C_S \leq 2 \quad (3)$$

wherein $C_P$ represents the content of phosphorus contained in the performance additive, and $C_S$ represents the content of sulfur contained in the performance additive, wherein $C_P$ and $C_S$ are amounts (mass %) based on the total mass of the composition;

wherein a high-temperature fatigue life of the lubricating composition is 1103 min or greater, where high temperature fatigue life is measured by a Unisteel rolling fatigue test under conditions of test piece: thrust needle, surface pressure: 2 GPa, oil temperature: 120° C., and number of rotations: 1410 rpm, and a pour point of the lubricating composition measured according to JIS K 2269-1987 is −20° C. or less.

2. The lubricating oil composition for gear oil according to claim 1, wherein the kinematic viscosity at 140° C. is 6.0 $mm^2/s$ or more.

* * * * *